US009345383B2

(12) United States Patent
Lee

(10) Patent No.: US 9,345,383 B2
(45) Date of Patent: May 24, 2016

(54) TAPE CLEANER

(71) Applicant: 3M INNOVATIVE PROPERTIES COMPANY, St. Paul, MN (US)

(72) Inventor: In-Hwan Lee, Hwaseong (KR)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/406,626

(22) PCT Filed: May 30, 2013

(86) PCT No.: PCT/US2013/043305
§ 371 (c)(1),
(2) Date: Dec. 9, 2014

(87) PCT Pub. No.: WO2013/188118
PCT Pub. Date: Dec. 19, 2013

(65) Prior Publication Data

US 2015/0107038 A1 Apr. 23, 2015

(30) Foreign Application Priority Data

Jun. 15, 2012 (KR) ..... 10-2012-0064531

(51) Int. Cl.
*A47L 25/00* (2006.01)
*A47L 13/38* (2006.01)

(52) U.S. Cl.
CPC ..... *A47L 25/005* (2013.01)

(58) Field of Classification Search
CPC ..... A47L 25/005; A47L 13/38; B44D 3/125
USPC ..... 15/104.002
See application file for complete search history.

(56) References Cited

U.S. PATENT DOCUMENTS 2,423,962 A * 7/1947 Clark ..... A47L 25/005 15/104.002
4,571,769 A 2/1986 Ford
(Continued)

FOREIGN PATENT DOCUMENTS

JP H08-002340 8/1988
JP H06-046987 2/1994
(Continued)

OTHER PUBLICATIONS

International Search Report for PCT International Application No. PCT/US2013/043305, mailed on Aug. 27, 2013, 3pgs.
(Continued)

*Primary Examiner* — Laura C Guidotti

(57) ABSTRACT

The disclosed tape cleaner comprises an adhesive tape roller, a support roller inserted in the adhesive tape roller and supporting the adhesive tape roller, an upper cover having both sides connected to both sides of the support roller and partially covering the outer circumferential surface of the adhesive tape roller, a rotary cover having both sides connected to both sides of the support roller, partially covering the outer circumferential surface of the adhesive tape roller, on the inside of the upper cover, and rotatable by 360° in both directions about the longitudinal direction of the support roller, and a handle connected with the upper cover. Both the adhesive tape roller and the support roller rotate about the longitudinal direction of the support roller, and the adhesive tape roller, the support roller, the upper cover and the rotary cover are all attachable and detachable.

14 Claims, 8 Drawing Sheets

(56) References Cited

U.S. PATENT DOCUMENTS

| | | | | | |
|---|---|---|---|---|---|
| 5,095,575 | A * | 3/1992 | Jarecki | B05C 17/0222 134/182 |
| 2004/0052570 | A1 * | 3/2004 | McKay | A01K 13/002 401/219 |

FOREIGN PATENT DOCUMENTS

| | | | | |
|---|---|---|---|---|
| JP | H09-075293 | | 3/1997 | |
| JP | U 3092551 | * | 9/2002 | A47L 25/00 |
| JP | 2003-190066 | | 7/2003 | |
| KR | 1993-0019336 | | 10/1993 | |
| KR | 20-0303861 | | 2/2003 | |
| KR | 2010-0001735 | | 2/2010 | |
| KR | 2010-0120748 | | 11/2010 | |
| KR | 2012-0039355 | | 4/2012 | |
| WO | 83/01734 | | 5/1983 | |
| WO | WO 83/01734 | * | 5/1983 | A47L 25/005 |

OTHER PUBLICATIONS

European Search Report for European Patent Application No. 13 80 3511, dated Feb. 11, 2016.

* cited by examiner

TAPE CLEANER

FIELD

The present disclosure relates to a tape cleaner that removes foreign substances, such as dust, hairs, and lint adhering to bed sheets, clothes and carpets.

BACKGROUND

Tape cleaners, also referred to a lint rollers, are widely used to remove various foreign substances, such as dust, hairs and lint adhering to the surfaces of fabrics, such as bed sheets, clothes and carpets. The tape cleaners are usually composed of an adhesive tape roller with an adhesive tape thereon, a protecting member that protects the adhesive tape roller, and a handle. Such tape cleaners are usually stored in specially designed cases when not in use. However, as the cases are not permanently affixed to the tape cleaners, the cases are often misplaced and are frequently lost.

Korean Utility Model Laid-Open Publication No. 2010-0001735 discloses an adhesive tape cleaner wherein a cleaning member and a protecting member are integrally formed (see FIG. 1). However, this adhesive tape remover is not convenient to use, because users have to open a left side cover (122) and a right side cover (124). Further, there is a problem in that the adhesive tape roller may be separated from the tape cleaner during use.

Korean Patent Laid-Open Publication No. 2010-0120748 discloses a tape cleaner that includes two gears (13, 15) and two rollers (4, 5) in which an adhesive tape removes foreign substances when the adhesive tape is wound on the rollers (see FIG. 2). However, there are problems in that the design is complicated and the manufacturing cost is high, since the tape cleaner requires two gears and two rollers.

SUMMARY

The disclosed tape cleaner is convenient to use, allows easy replacement of the tape adhesive, and prevents an adhesive tape roller from separating from the tape cleaner during use. The roller and the cover are integrally formed to avoid the loss or misplacement of the cover. Accordingly, storage is convenient and the exposed adhesive tape surface is not damaged. Further, the cover can be conveniently opened and closed, and the adhesive tape can be easily replaced.

In one embodiment, a tape cleaner comprises an adhesive tape roller, a support roller inserted in the adhesive tape roller to support the adhesive tape roller, an upper cover having both sides connected to both sides of the support roller and partially covering the outer circumferential surface of the adhesive tape roller, a rotary cover having both sides connected to the ends of both sides of the support roller, partially covering the outer circumferential surface of the adhesive tape roller, on the inside of the upper cover, and rotatable by 360° in both directions about the longitudinal direction of the support roller, and a handle connected with the upper cover. Both the adhesive tape roller and the support roller may rotate about the longitudinal direction of the support roller, and the adhesive tape roller, the support roller, the upper cover and the rotary cover can all be attached and detached.

DETAILED DESCRIPTION

Figure 1:
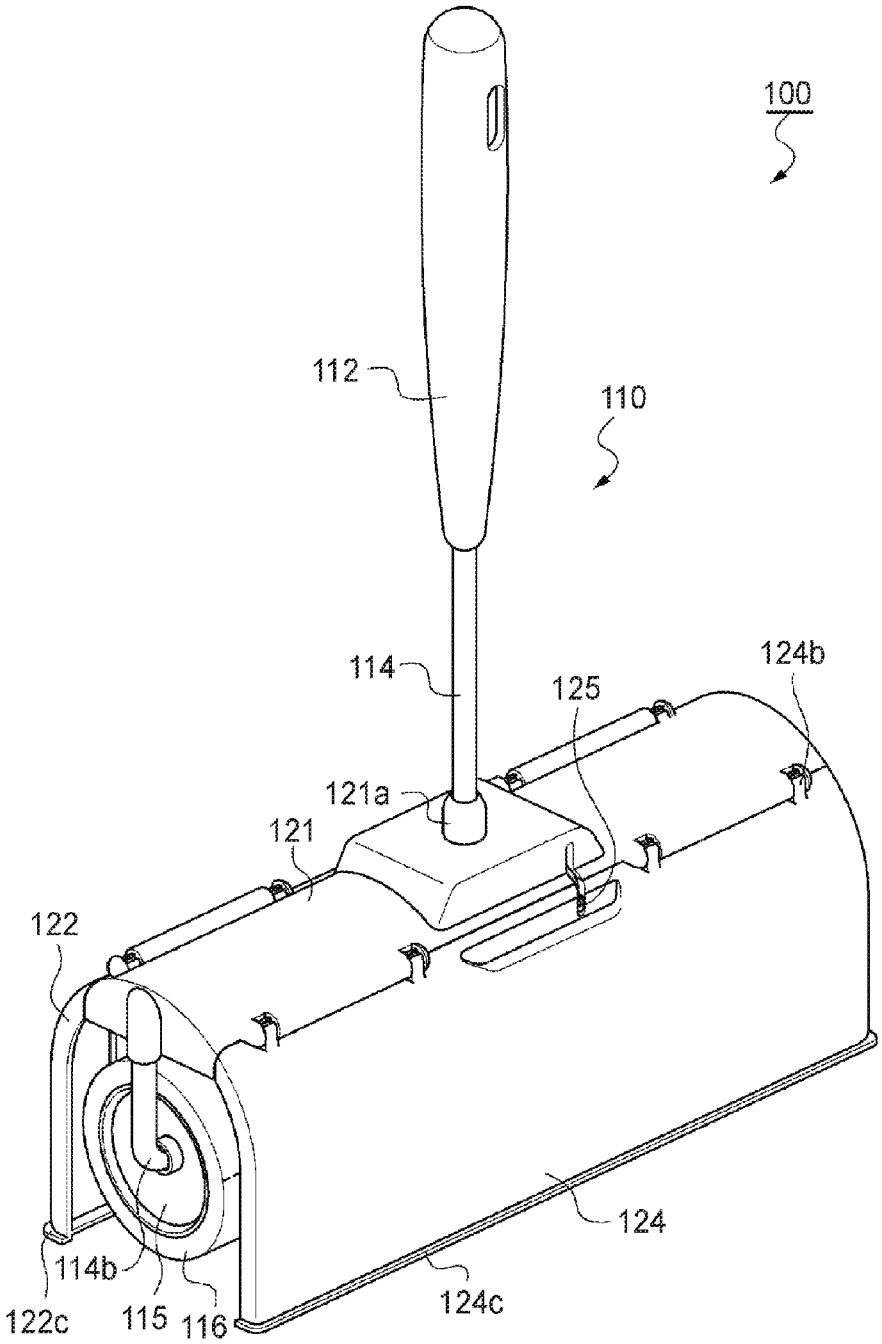
FIG. 1 Prior Art
FIG. 1 is a tape cleaner according to Korean Utility Model Laid-Open Publication No. 2010-0001735.
Figure 2:
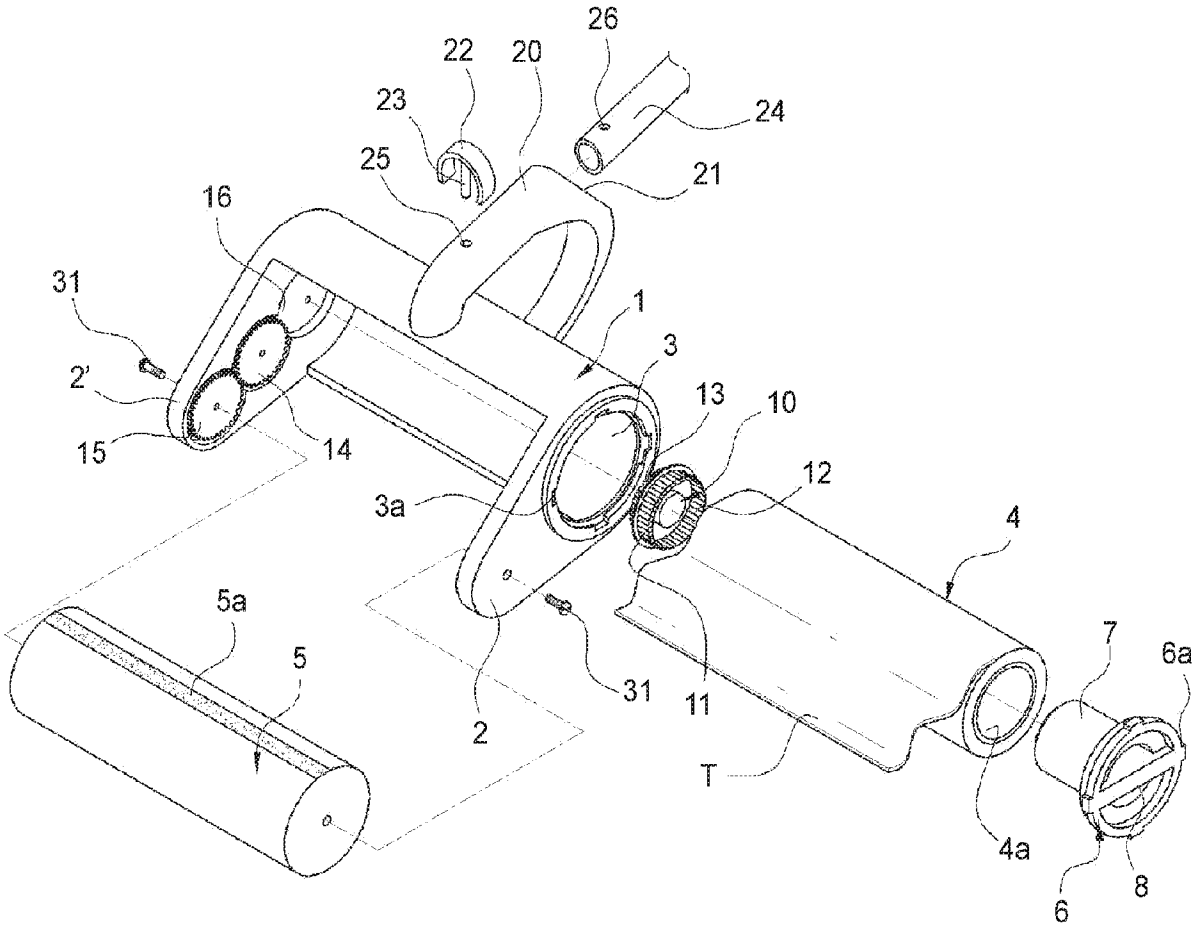
FIG. 2 Prior Art
FIG. 2 is a tape cleaner according to Korean Patent Laid-Open Publication No. 2010-0120748.
Figure 3:
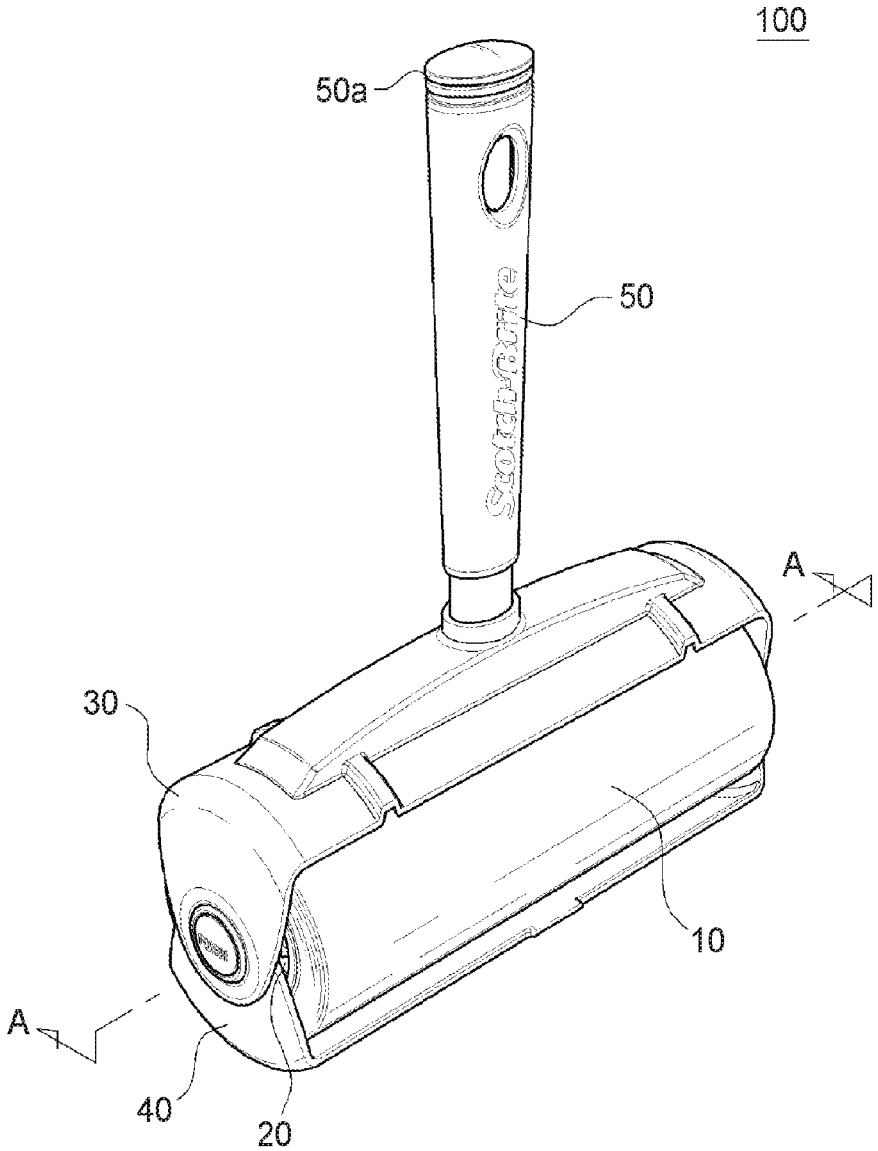
FIG. 3 is a perspective view of an embodiment of a tape cleaner.

FIG. 3 is a perspective view of an embodiment of a tape cleaner 100. The tape cleaner includes an adhesive tape roller 10, a support roller 20 inserted in the adhesive tape roller 10 to support the adhesive tape roller 10, an upper cover 30 having both sides connected to the sides of the support roller 20 and partially covering the outer circumferential surface of the adhesive tape roller 10, a rotary cover 40 having both sides connected to the sides of the support roller 20, partially covering the outer circumferential surface of the adhesive tape roller 10, on the inside of the upper cover 30, and rotatable by 360° in both directions about the longitudinal direction of the support roller 20, and a handle 50 connected with the upper cover 30. Both the adhesive tape roller 10 and the support roller 20 can rotate about the longitudinal direction of the support roller 20, and the adhesive tape roller 10, the support roller 20, the upper cover 30 and the rotary cover 40 can all be attached and detached.

Figure 4:
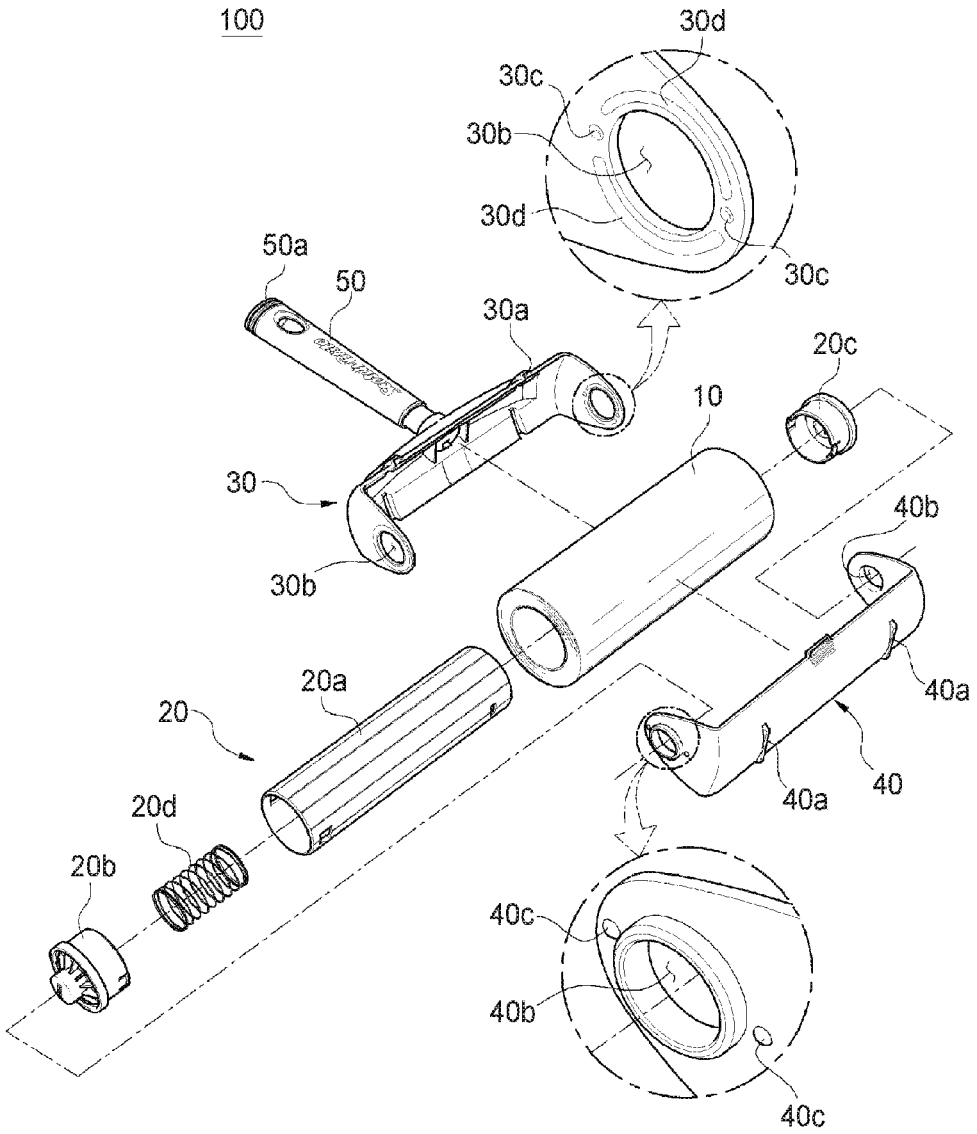
FIG. 4 is an exploded perspective view of an embodiment of the tape cleaner.

FIG. 4 an exploded perspective view of the tape cleaner 100.

The adhesive tape roller 10 is a common roll-shaped adhesive tape with an adhesive tape wound on the surface of the roll. The adhesive tape roller 10 has a plurality of adhesive sheet layers on the outer circumferential surface. When adhesive force of the sheet layer is decreased due to extended use, one can separate the adhesive sheets one by one from the adhesive tape roller 10, thereby exposing a new adhesive sheet. The adhesive tape roller 10 has a hole at the center of both sides so that the support roller 20 can be inserted. Preferably, the adhesive tape roller 10 has a cut or perforated tear line for each circumference of the roll of the adhesive tape, so that the used adhesive tape can be easily torn off and replaced with a new adhesive tape.

The support roller 20 is inserted in the hole of the adhesive tape roller 10 and supports the adhesive tape roller 10. Referring to FIG. 4, the support roller 20 preferably includes a support roller core 20*a*, a support roller side cap 20*b*, a second support roller side cap 20*c* and an elastic member 20*d*.

Figure 5:
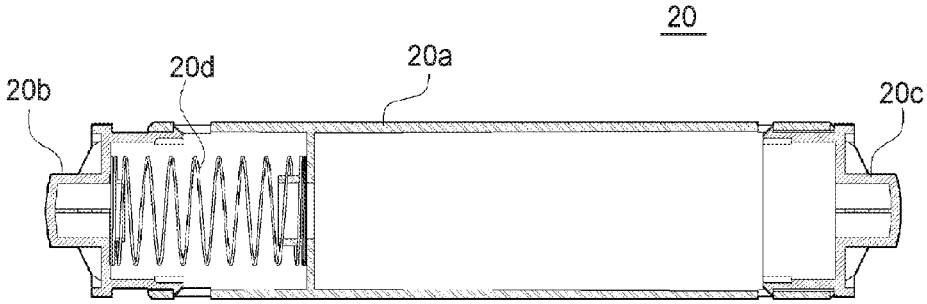
FIG. 5 is a cross-sectional view of a support roller used in an embodiment of the tape cleaner.

FIG. 5 shows the support roller 20 wherein the support roller core 20*a*, support roller side cap 20*b*, second support roller side cap 20*c* and elastic member 20*d* are all combined. As shown in FIG. 5, the elastic member 20*d* may be disposed at the end facing the support roller side cap 20*b* in the support roller core 20*a*. A spring may be used as an elastic member 20*d*. Further, a partition wall may be formed on the inside of the support roller core 20*a*. The elastic member 20*d* may be positioned between the support roller side cap 20*b* and the partition wall.

The tape cleaner facilitates separation of the adhesive tape from the tape cleaner, and replacement of the used adhesive tape. In order to replace the adhesive tape roller 10, a button of the support roller side cap 20*b* is pressed, and force is applied to the elastic member 20*d* in which the length of the elastic member 20*d* is shortened. Gaps are then formed between one side of the upper cover 30 and the support roller side cap 20*b*, and through the gaps, the adhesive tape roller 10 and the support roller 20 may be separated from the upper cover 30. In addition, gaps are formed between one side of the rotary cover 40 and the support roller side cap 20*b*. Through the gaps, the adhesive tape roller 10 may be easily separated from the support roller 20. As a result, the used adhesive tape roller may be easily replaced through the push of a button.

Both sides of the upper cover 30 are connected with the sides of the support roller 20, respectively (see FIG. 4). The upper cover 30 may have holes 30*b* on both sides. The upper cover 30 and the support roller 20 may be combined by inserting the side cap 20*b* and the second side cap 20*c* into the holes 30*b*.

Further, the upper cover 30 partially covers the outer circumferential surface of the adhesive tape roller 10. In this case, a predetermined gap is preferably provided between the upper cover 30 and the outer circumferential surface of the adhesive tape roller 10.

Figure 6:
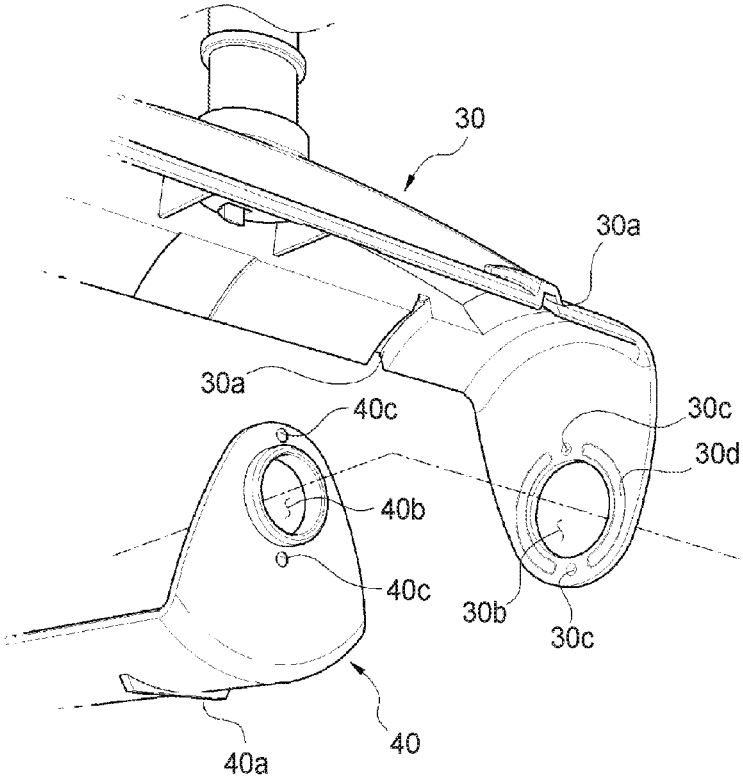
FIG. 6 is an exploded perspective view of an embodiment of the upper cover and the rotary cover, when combined, used in the tape cleaner.

As shown in FIGS. 4 and 6, the upper cover 30 may have grooves 30*c* and guides 30*d* on the inner surfaces of both sides.

Both sides of the rotary cover 40 are connected with the sides of the support roller 20, respectively. In one embodiment, the rotary cover 40 may have holes 40*b* on both sides. Both sides of the support roller 20 can be inserted into the holes 40*b*.

The rotary cover 40 partially covers the outer circumferential surface of the adhesive tape roller 10 on the inside of the upper cover 30. In this case, a predetermined gap is preferably provided between the rotary cover 40 and the outer circumferential surface of the adhesive tape roller 10.

The rotary cover 40 can rotate by 360° in both directions (in clockwise direction and counter-clockwise direction) about the longitudinal direction of the support roller 20.

The rotary cover 40 has side protrusions 40*c* on the outer surfaces of both sides, and the side protrusions 40*c* can move along the guides 30*d* and can be inserted into the grooves 30*c*.

Figure 7:
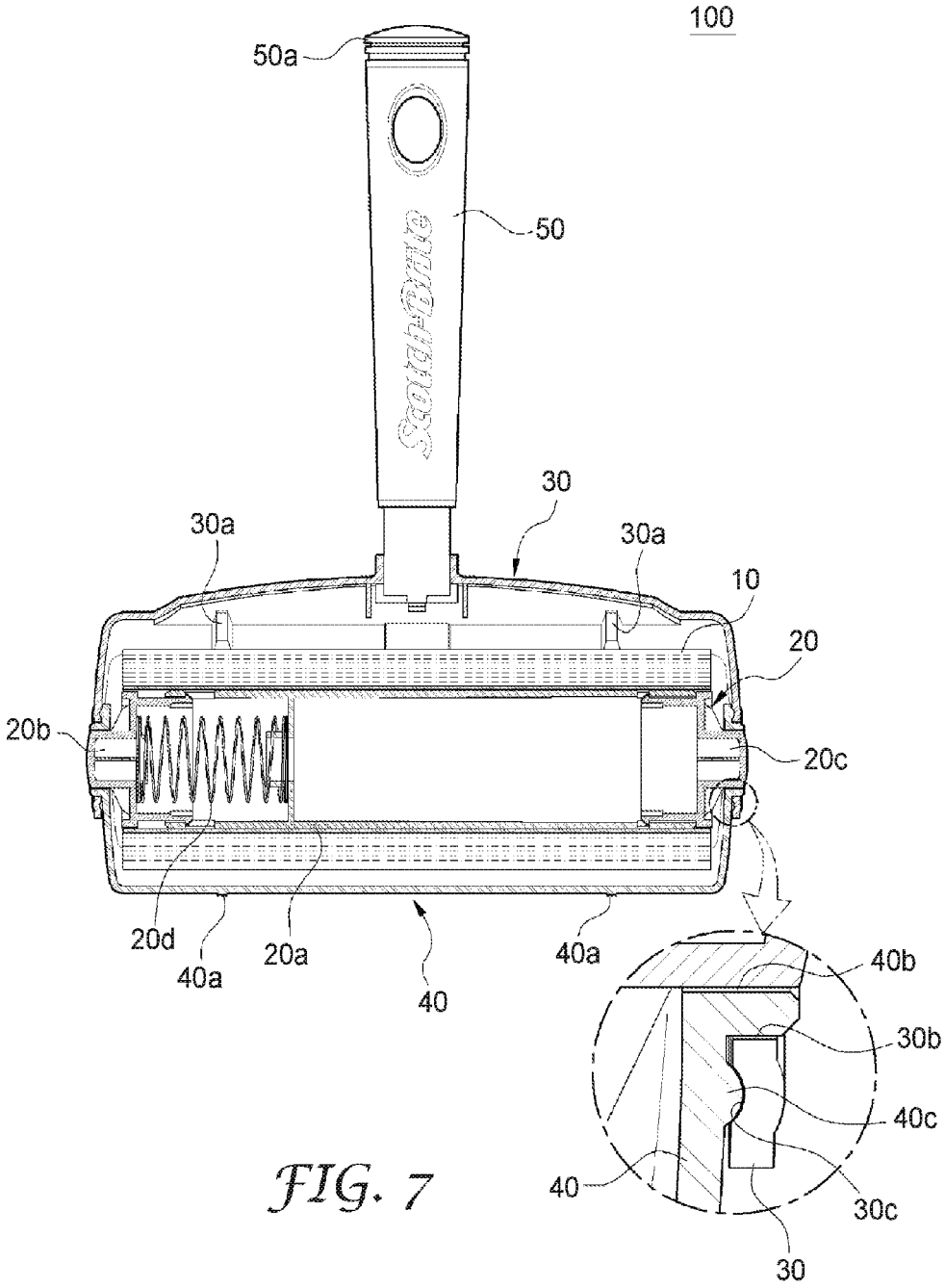
FIG. 7 is a cross-sectional view of an embodiment of the tape cleaner.

Referring to FIGS. 6 and 7, the combined shape of the upper cover 30 and the rotary cover 40 that are used in the tape cleaner is explained hereinafter. As shown in FIG. 6, the rotary cover 40 has two side protrusions 40*c* on each side, and the upper cover 30 has two grooves 30*c* and two guides 30*d* on each of the sides. When the rotary cover 40 and the upper cover 30 are combined, the two side protrusions 40*c* may be fitted into the grooves 30*c* on both sides, respectively. The enlarged view of the combined portion of the rotary cover 40 and the upper cover 30 in FIG. 7 shows the state when the side protrusions 40*c* are fitted in the grooves 30*c*.

Figure 8:
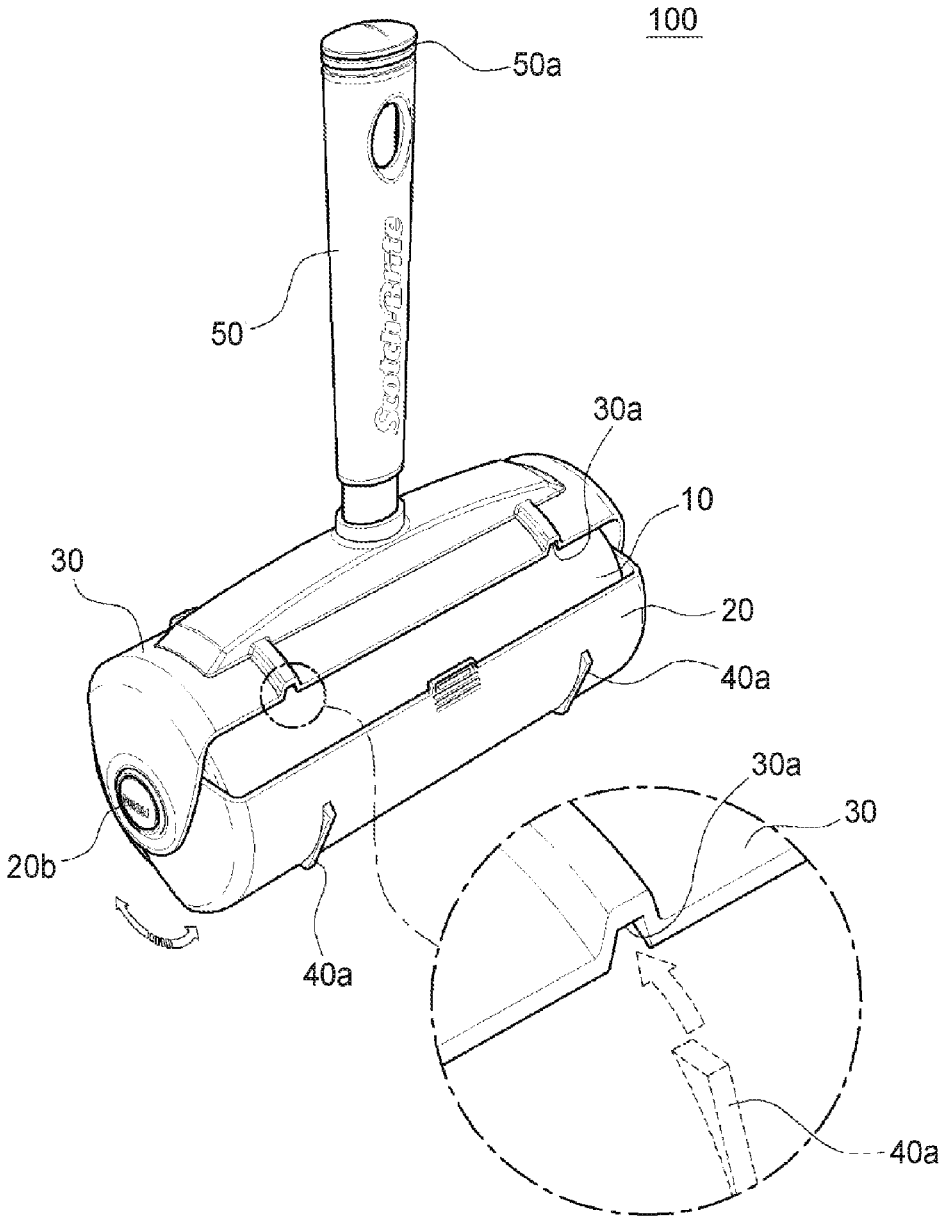
FIG. 8 is a perspective view of an embodiment of the tape cleaner when the rotary cover is rotated.

The rotary cover 40 may have a support member 40*a* at the bottom. The support member 40*a* supports the tape cleaner when not in use. When the rotary cover 40 has a support member 40*a*, the upper cover 30 may have a groove 30*a* that can receive the support member 40*a*. As shown in FIG. 8, when the tape cleaner 100 is converted from storage mode to use mode by rotating the rotary cover 40, the support members 40*a* may be received into the grooves 30*a*.

A handle 50 may be connected with the upper cover 30. A handle cap 50*a* may be mounted on the top of the handle 50. In one embodiment, the handle 50 is made of rubber in order to prevent sliding Hereinafter, the storage state and the use state of the tape cleaner are described in detail.

Figure 9A:
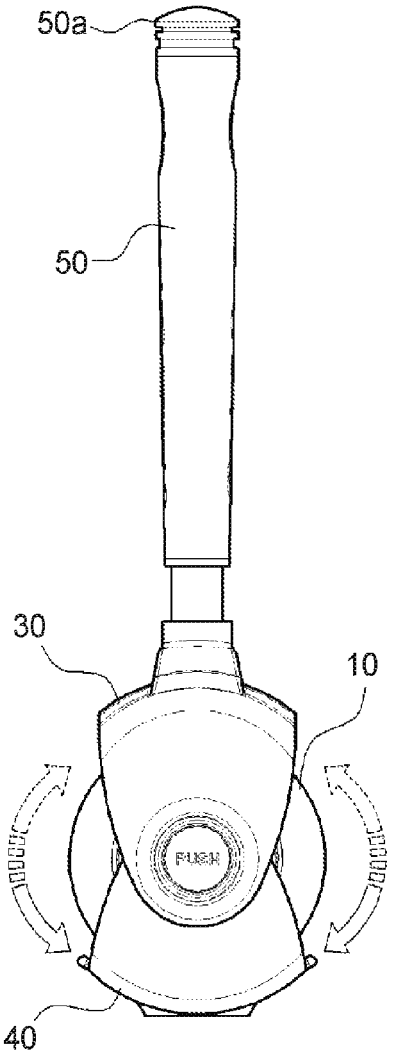
FIG. 9*a* is a side view of an embodiment of the tape cleaner when not in use.

FIG. 9*a* shows the state when the tape cleaner 100 is not in use. The rotary cover 40 is positioned under the adhesive tape roller 10 and functions as a support. Accordingly, it is possible to prevent the lower portion of the adhesive tape roller 10 from being exposed to pollutants. Further, in this state, the side protrusions 40*c* on both sides of the rotary cover 40 are fitted into the grooves 30*c* (see FIG. 7).

Figure 9B:
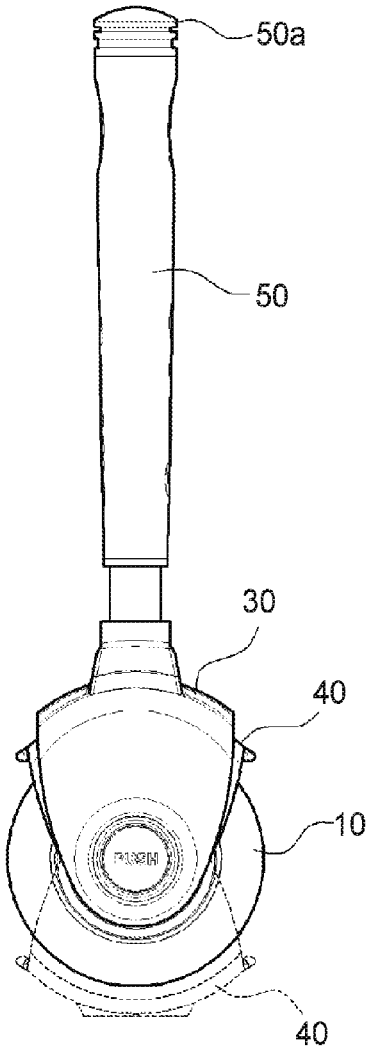
FIG. 9*b* is a side view of an embodiment of the tape cleaner when in use.

FIG. 9*b* shows the state when the tape cleaner is in use, wherein the rotary cover 40 is rotated at 180° from the state of non-use in FIG. 9*a*. When the side protrusions 40*c* on both sides of the rotary cover 40 are rotated at 180° along the guides 30*d* on both sides of the upper cover 30, they are fitted into the grooves 30*c* and fixed. The rotary cover 40 is positioned over the adhesive tape roller 10, and the lower portion of the adhesive tape roller 10 is opened, so that foreign substances on the bottom can be removed.

Further, when the rotary cover 40 is rotated again with the lower portion of the adhesive tape roller 10 open (namely, when the tape cleaner is in use mode, see FIG. 9*b*), the side protrusions 40*c* on both sides of the rotary cover 40 are moved again along the guides 30*d* on both sides of the upper cover 30. When the side protrusions 40*c* are rotated by 180°, they are fitted and fixed again in the grooves 30*c*, and the rotary cover 40 can be fixed again with the lower portion of the adhesive tape roller closed (namely, when the tape cleaner is in non-use mode, see FIG. 9*a*).

As described above, the tape cleaner can be easily converted from a state of use to a state of non-use or vice versa.

The invention described above is not limited to the exemplary embodiments and the accompanying drawings. It should be understood that various changes and modifications by those skilled in the art that are within the scope described in the claims are included in the scope of this invention.

What is claimed is:

1. A tape cleaner comprising:

an adhesive tape roller;

a support roller inserted in the adhesive tape roller to support the adhesive tape roller;

an upper cover having both sides connected to both sides of the support roller and partially covering the outer circumferential surface of the adhesive tape roller;

a rotary cover having both sides connected to both sides of the support roller, partially covering the outer circumferential surface of the adhesive tape roller, on the inside of the upper cover, and rotatable by 360° in both directions about the longitudinal direction of the support roller; and a handle connected with the upper cover, wherein both the adhesive tape roller and the support roller rotate about the longitudinal direction of the support roller, and the adhesive tape roller, the support roller, the upper cover and the rotary cover are all attachable and detachable, wherein the tape cleaner is fixed when the rotary cover is completely covered by the upper cover and when the rotary cover is rotated by 180° about the longitudinal direction of the support roller and positioned to be symmetric to the upper cover, and wherein the upper cover has guides and grooves on the inner surfaces of both sides, and the rotary cover has side protrusions on the outer surfaces of both sides, such that the side protrusions can move along the guides and can be fitted into the grooves, thereby fixing the rotary cover.

2. The tape cleaner of claim 1, wherein the upper cover has two guides and two grooves on the inner surfaces of both sides, respectively, and the rotary cover has one side protrusion at the upper and lower portions, respectively, on the outer surfaces of both sides, such that the side protrusions can move along the guides and can be fitted into the grooves, thereby fixing the rotary cover.

3. The tape cleaner of claim 1, wherein the rotary cover has support members at the bottom.

4. The tape cleaner of claim 3, wherein the upper cover has grooves that can receive the support members of the rotary cover.

5. The tape cleaner of claim 1, wherein the support roller includes a support roller core, a support roller side cap, a support roller second side cap and an elastic member.

6. The tape cleaner of claim 5, wherein a partition wall is formed in the support roller core and the elastic member is disposed between the support roller side cap and the partition wall.

7. The tape cleaner of claim 6, wherein a button is disposed on the support roller side cap and the elastic member can be compressed by pressing a button.

8. A tape cleaner comprising:

an adhesive tape roller;

a support roller inserted in the adhesive tape roller to support the adhesive tape roller;

an upper cover having both sides connected to both sides of the support roller and partially covering the outer circumferential surface of the adhesive tape roller;

a rotary cover having both sides connected to both sides of the support roller, partially covering the outer circumferential surface of the adhesive tape roller, on the inside of the upper cover, and rotatable by 360° in both directions about the longitudinal direction of the support roller; and a handle connected with the upper cover, wherein both the adhesive tape roller and the support roller rotate about the longitudinal direction of the support roller, and the adhesive tape roller, the support roller, the upper cover and the rotary cover are all attachable and detachable, wherein the rotary cover has support members at the bottom, and wherein the upper cover has grooves that can receive the support members of the rotary cover.

9. The tape cleaner of claim 8, wherein the tape cleaner is fixed when the rotary cover is completely covered by the upper cover and when the rotary cover is rotated by 180° about the longitudinal direction of the support roller and positioned to be symmetric to the upper cover.

10. The tape cleaner of claim 9, wherein the upper cover has guides and grooves on the inner surfaces of both sides, and the rotary cover has side protrusions on the outer surfaces of both sides, such that the side protrusions can move along the guides and can be fitted into the grooves, thereby fixing the rotary cover.

11. The tape cleaner of claim 10, wherein the upper cover has two guides and two grooves on the inner surfaces of both sides, respectively, and the rotary cover has one side protrusion at the upper and lower portions, respectively, on the outer surfaces of both sides, such that the side protrusions can move along the guides and can be fitted into the grooves, thereby fixing the rotary cover.

12. The tape cleaner of claim 8, wherein the support roller includes a support roller core, a support roller side cap, a support roller second side cap and an elastic member.

13. The tape cleaner of claim 12, wherein a partition wall is formed in the support roller core and the elastic member is disposed between the support roller side cap and the partition wall.

14. The tape cleaner of claim 13, wherein a button is disposed on the support roller side cap and the elastic member can be compressed by pressing a button.

* * * * *